US005370295A

United States Patent [19]

Simonelli

[11] Patent Number: 5,370,295

[45] Date of Patent: Dec. 6, 1994

[54] FEED MECHANISM FOR GRAVITY FEED TACKERS

[75] Inventor: David J. Simonelli, Coventry, R.I.

[73] Assignee: Stanley-Bostitch, Inc., East Greenwich, R.I.

[21] Appl. No.: 130,907

[22] Filed: Oct. 4, 1993

[51] Int. Cl.[5] ..... B25C 1/04

[52] U.S. Cl. ..... 227/119; 227/130; 227/136

[58] Field of Search ..... 227/120, 130, 136, 138, 227/119

[56] References Cited

U.S. PATENT DOCUMENTS

| | | | |
|---|---|---|---|
| 2,707,277 | 8/1953 | Aldrich . | |
| 2,931,038 | 11/1955 | Wandel . | |
| 3,232,511 | 2/1966 | Crooks | 227/136 |
| 3,469,758 | 9/1969 | Volkmann | 227/120 |
| 3,504,840 | 2/1968 | Wandel . | |
| 3,563,438 | 12/1968 | Doyle . | |
| 3,708,097 | 1/1973 | Fisher . | |
| 3,734,377 | 5/1973 | Munn . | |
| 3,826,419 | 7/1974 | Maestri | 227/136 |
| 3,854,648 | 12/1974 | Inzoli et al. . | |
| 4,442,965 | 4/1984 | Leistner | 227/136 |
| 4,728,021 | 3/1988 | Kennedy . | |
| 4,981,246 | 1/1991 | Kennedy . | |

*Primary Examiner*—Scott A. Smith
*Attorney, Agent, or Firm*—Cushman, Darby & Cushman

[57] ABSTRACT

In a fastener driving apparatus including a nose piece assembly defining an elongated drive track receiving a fastener driving element therein movable through an operating cycle including a drive stroke and return stroke, and a fastener feeding track communicating laterally with the drive track, an improved mechanism for feeding fasteners from a fastener package into a position to be driven by the fastener driving element during the drive stroke thereof is provided. The feeding mechanism includes an actuating mechanism mounted for movement through an operating cycle including (1) an operative stroke in a direction along the fastener feeding track toward the drive track for feeding fasteners to the drive track and (2) a return stroke. A fastener holding mechanism is also provided and is operatively coupled to the actuating mechanism for movement therewith through the operating cycle thereof, whereby during the operative stroke of the actuating mechanism the fastener holding mechanism holds the fasteners in position biased toward the drive track during at least a portion of the drive stroke so that a leading fastener from the fastener package is disposed in the drive track in position to be contacted by the driving element. The fastener holding mechanism is released from the fasteners during the return stroke of the actuating mechanism, during a portion of operating cycle of the driving element when a fastener need not be held in the drive track.

8 Claims, 2 Drawing Sheets

FEED MECHANISM FOR GRAVITY FEED TACKERS

BACKGROUND OF THE INVENTION

This invention relates to a feeding mechanism for fastener driving devices and more particularly to fastening devices used in continuous production lines having a feeding mechanism for feeding successive fasteners into the drive track of the device.

Conventional staple feeding mechanisms must perform the task of feeding and holding the staples in the drive track. In certain devices, sticks of staples are loaded onto a magazine that is angled downward so that the force of gravity aids in pulling the staples down to the nose of the device and into the drive track. However, the force of gravity alone is insufficient to feed and hold the staples in the drive track.

To increase the force on the staples at the nose of the device, a mechanism has been used including a friction clutch and a wheel connected to an electric motor. Thus, as the motor turns, the clutch maintains a certain torque on the wheel which in turn keeps a constant forward force on the staples. When a staple is driven, the remaining staples are fed and held forward toward the drive track. Other conventional feed mechanisms use a ratchet to hold and feed staples to the drive track. The feed is made under spring pressure and the cycling action for the feed stroke comes during the power stroke of the device. It is common to connect the return piston to a source of air under pressure which is communicated in response to the actuation of the device. Consequently, instead of feeding during the drive stroke, the conventional ratchet is recycling or retracting during the drive stroke and the fastener which has already been fed into the drive track is held therein by a holding pawl. Although these type of feed mechanisms work well for their intended purpose, they typically require an extra power source to be connected to the device, and are inefficient and expensive.

Other conventional feed mechanisms employ a spring biased pusher which contacts the rearmost staple of the staple stick urging the staples forward along a guide to the drive track. The devices are effective in feeding and holding the staples in the drive track of the device, however, when a staple stick has been exhausted, the pusher must be retracted to allow another staple stick to be placed on the guide. In a continuous production line such interruptions can be disruptive and costly due to lost productivity.

SUMMARY OF THE INVENTION

An object of the present invention is to provide a fastener feeding mechanism for a fastener driving device which requires no additional power source to hold the staples in the drive track and which permits a supply of fasteners to be fed to the drive track continuously, limited only by the supply of fasteners provided.

It is further object of the present invention to provide a feed mechanism which uses spring bias to hold the leading fastener in the drive track during the fastener driving stroke and to provide pneumatic cycling to operate the feed mechanism during a portion of the operating cycle of the drive element when it is not necessary to hold a leading fastener in the drive track. Thus, the feeding mechanism may be advantageously signalled by the device's plenum air and is automatically timed to the device's engine cycle.

In accordance with the principles of the present invention, these objectives are obtained by providing in a fastener driving apparatus including a nose piece assembly defining an elongated drive track receiving a fastener driving element therein movable through an operating cycle including a drive stroke and return stroke, and a fastener feeding track communicating laterally with the drive track, an improved mechanism for feeding fasteners from a fastener package into a position to be driven by the fastener driving element during the drive stroke thereof is provided. The feeding mechanism includes an actuating mechanism mounted for movement through an operating cycle including (1) an operative stroke in a direction along the fastener feeding track toward the drive track for feeding fasteners to the drive track and (2) a return stroke. A fastener holding mechanism is also provided and is operatively coupled to the actuating mechanism for movement therewith through the operating cycle thereof, whereby during the operative stroke of the actuating mechanism the fastener holding mechanism holds the fasteners in position biased toward the drive track during at least a portion of the drive stroke so that a leading fastener from the fastener package is disposed in the drive track in position to be contacted by the driving element. The fastener holding mechanism is released from the fasteners during the return stroke of the actuating mechanism, during a portion of operating cycle of the driving element when a fastener need not be held in the drive track.

Another object of the present invention is the provision of a device of the type described, which is simple in construction, effective in operation and economical to manufacture and maintain.

These and other objects of the present invention will become apparent during the course of the following detailed description and appended claims.

The invention may be best understood with reference to the accompanying drawings wherein an illustrative embodiment is shown.

Figure 1:
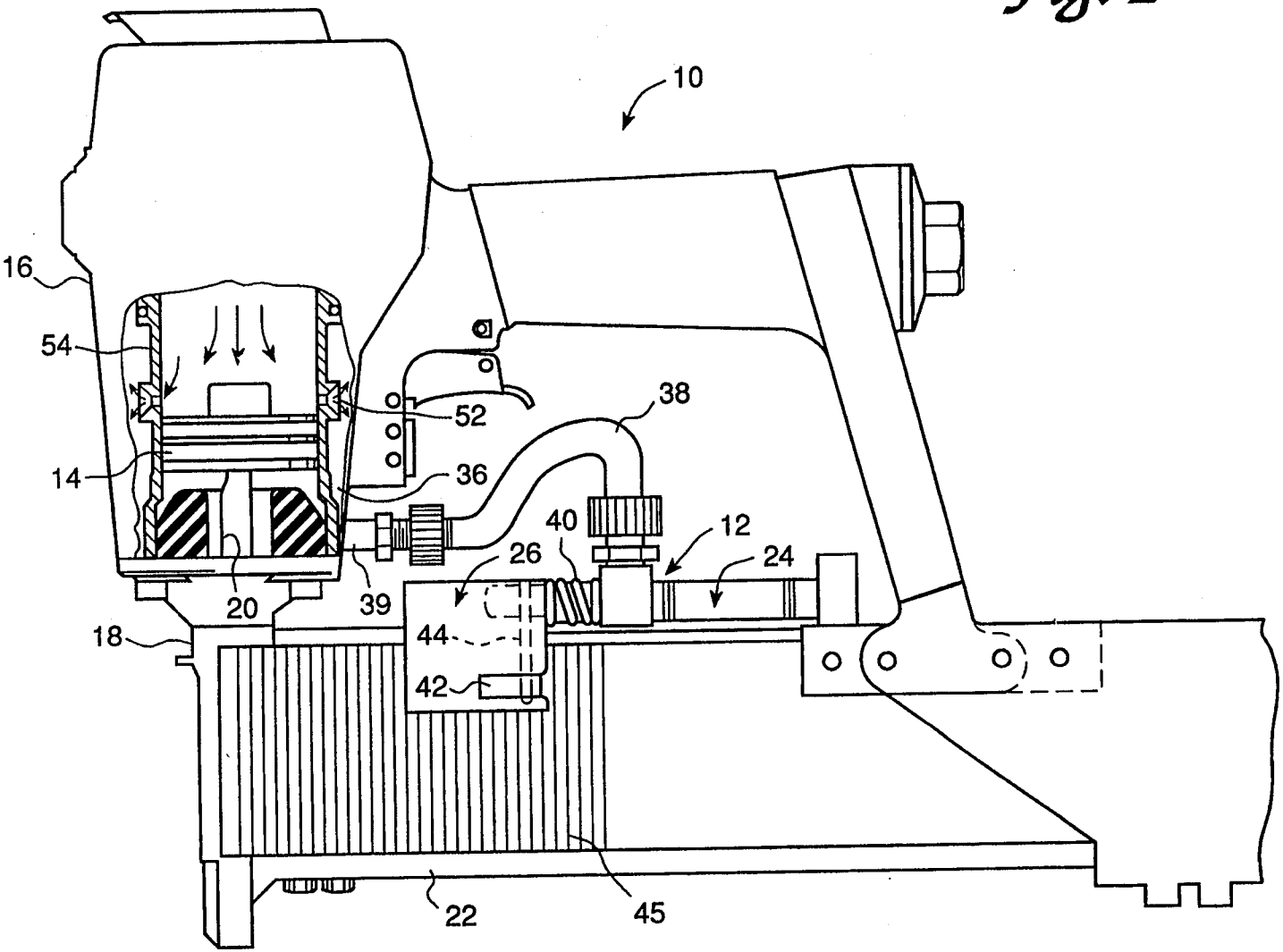
FIG. 1 is a side elevation view, with parts in section, of a pneumatically operated fastener driving device including a feeding mechanism provided in accordance with the principles of the present invention.
Figure 2:
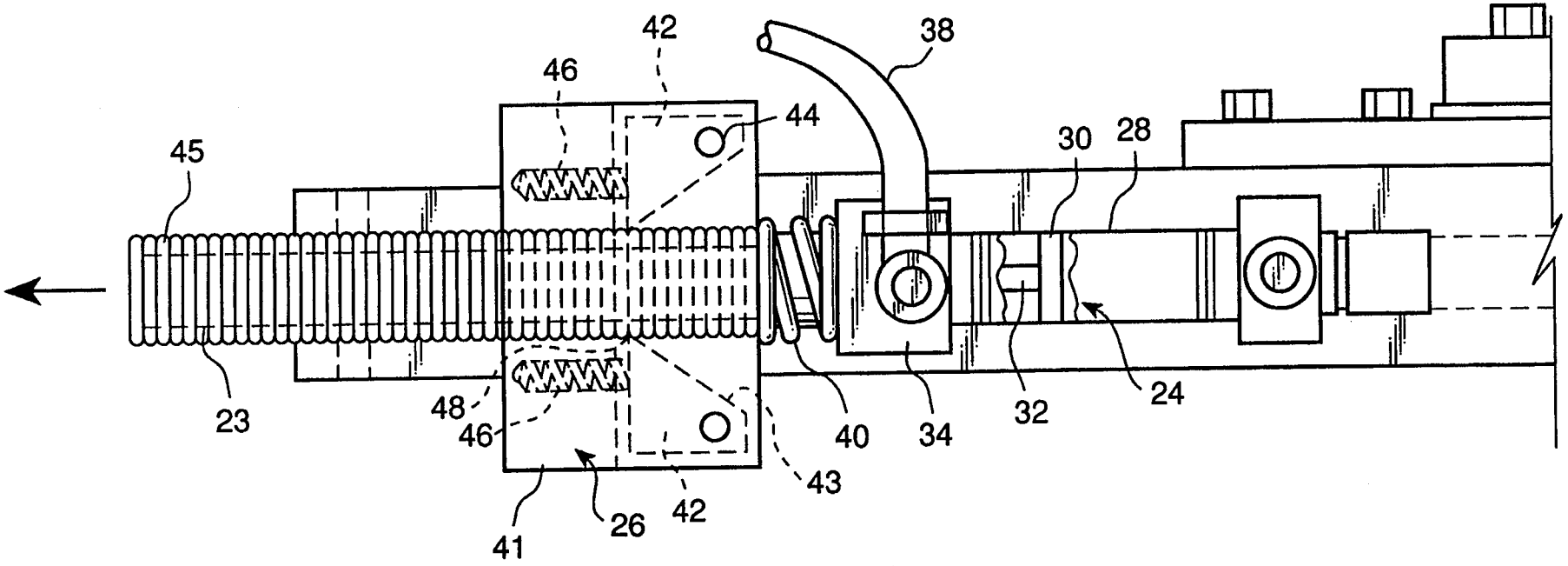
FIG. 2 is a plan view of the fastener feeding mechanism provided in accordance with the principles of the present invention.

Referring now more particularly to FIGS. 1 and 2 of the drawings, a fastener driving device, generally indicated at 10 is shown having a fastener feeding mechanism, generally indicated at 12, embodying the principle of the present invention. The device 10 includes the usual fastener driving element 14 which is moved through an operating cycle including a drive stroke and a return stroke preferably by a conventional pneumatic system (not shown).

The device 10 includes a rigid housing 16 including a nose piece 18 having internal surfaces defining an elongated drive track 20. A staple magazine assembly 22 is secured to the nose piece 18 and extends rearwardly therefrom. The magazine assembly 22 may be of any conventional design, is adapted to receive a supply of staples in the form of a staple stick and support and guide the staples forwardly along a feed track 23 into the drive track to be driven outwardly thereof by the staple driving element 14. As shown in FIG. 1, a portion of the staple stick is exposed, the function of which will become apparent below.

The feeding mechanism 12 includes an actuating mechanism generally indicated at 24 and a fastener holding mechanism, generally indicated at 26. As best shown in FIG. 2, the actuating mechanism includes a cylinder 28 coupled to the device 10 at one end thereof. A piston 30 is slidably mounted within the cylinder and has a piston actuating rod 32 formed thereon extending outwardly of the cylinder. The outer end of the actuating rod 32 is coupled to the holding mechanism. The piston-cylinder arrangement may be of any conventional design, for example, Model No. 01DX manufactured by BIMBA. The actuating mechanism also includes an air inlet portion 34 which communicates with the plenum chamber 36 of the device 10 via tube 38 and connector 39, the function of which will become apparent below. The actuating mechanism 24 further includes a spring 40 coupled to the holding mechanism 26 at one end thereof, with the other end being in contact with a surface of the inlet portion 34. The spring 40 normally biases the holding mechanism in a direction toward the drive track.

As shown in FIG. 2, the fastener holding mechanism 26 includes a feed block 41 supporting a pair of holding pawls 42 disposed on opposing sides of the staple stick 45. Each holding pawl 42 is pivotally coupled to the feed block 41 by a pin 44 at one end thereof. A compression spring 46 is coupled to an opposite end of each holding pawl 42 at a position offset from an axis of the pin 44. The other end of the compression spring 46 is coupled to the feed block 41. Each holding pawl 42 includes an angled surface 43 terminating at engaging edge 48. Edge 48 contacts a point between staples of the exposed side portion of the staple stick due to the bias of spring 40.

The operation of the mechanism 12 will be appreciated with reference to FIGS. 1 and 2. Spring 40 normally biases the holding mechanism in a position toward the drive track during an operating stroke of the actuating mechanism. The forward motion of the holding mechanism 26 causes the holding pawls 42 to contact the staple stick so as to hold the staple stick, due to a moment created by the compression springs 46 being offset from the pins 44. Thus, during an initial part of the drive stroke, the spring 40 ensures that a leading staple of the staple stick is disposed in the drive track. The driving element then moves downward within the drive track and contacts the leading staple. When the driving element has sheared off the leading staple and is part-way through its drive stroke, the driving element passes plenum feed holes 52 in cylinder sleeve 54. Pressurized air then flows into plenum chamber 36 which is fed through tube 38 and into the pneumatic cylinder 28. The pressurized air moves the piston 30 in a direction away from the drive track compressing the spring 40, thus permitting the holding mechanism 26 to move away from the drive track during a return stroke of the actuating mechanism. When the holding mechanism is pulled-back in a direction away from the feeding direction by the pneumatic cylinder 30, the holding pawls 42 ratchet-off the staple stick while maintaining contact therewith, due to the force of inertia of the remaining staples acting on angled surface 43 of the holding pawls 42.

The angle of surface 43 and the spring force of springs 46 are such that the holding pawls ratchet-off successive staples, thus, not pulling the staples back along the feed track toward the cylinder 30. Thus, the holding pawls move from their holding position during the return stroke of the actuating mechanism, during a portion of the operating cycle of the device 10 when it is not critical to hold the staples securely in the nose piece 18.

After the return stroke of the driving element 14 is complete, the plenum air is exhausted through the nose piece 18 and removed from the cylinder 30 which causes spring 40 to expand and again push the holding mechanism 26 toward the drive track which moves the holding pawls into their holding position to move the fasteners forward along the feed track and to hold a leading staple of the fastener package in the drive track.

From the foregoing, it can be appreciated that the fastener feeding mechanism offers numerous advantages over prior art devices. Since feeding and holding of the staples is not performed from behind the staple stick, feeding is only limited by the length of the staple stick and need not be interrupted, for example, to retract a pusher.

Further, the mechanism requires no extra power source to be connected to the device. The mechanism is signaled by the device's plenum air and is automatically timed to the operating cycle. In addition, since the plenum air is used against a spring, the mechanism is efficient.

It thus will be appreciated that the objects of the invention have been fully and effectively accomplished. It will be realized, however, that the foregoing preferred embodiment of the present invention has been shown and described for the purpose of illustrating the structural and functional principles of the present invention and is subject to change without departure from such principles. For example, although the present invention was described with reference to staple fasteners, it is contemplated that the mechanism of the present invention may be employed for feeding other fasteners, such as nails. Thus, the invention includes all the modifications encompassed within the spirit of the following claims.

What is claimed is:

1. In a fastener driving apparatus including a nose piece assembly defining an elongated drive track receiving a fastener driving element therein movable through an operating cycle including a drive stroke and return stroke, and a magazine assembly for supporting and guiding a fastener package along a feed track in a feeding direction, a fastener feeding mechanism for moving successive leading fasteners of the fastener package in the feeding direction along the feed track into the drive track to be driven by the fastener driving element during the drive stroke thereof outwardly of the drive track into the work piece, the fastener feeding mechanism comprising:

an actuating mechanism mounted to the fastener driving apparatus for movement through an operating cycle including (1) an operative stroke in the feeding direction along the fastener feed track toward the drive track for feeding fasteners to the drive track and (2) a return stroke; and a fastener holding mechanism operatively coupled to said actuating mechanism for movement therewith through the operating cycle thereof, whereby (1) during the operative stroke of the actuating mechanism, the fastener holding mechanism feeds the fasteners along the feed track and holds the fasteners in position biased toward the drive track during at least a portion of the drive stroke so that a leading fastener from the fastener package is disposed in the drive track in position to be contacted by the driving element, and (2) during the return stroke of the actuating mechanism and during a portion of operating cycle of the driving element when a fastener need not be held in the drive track, the fastener holding mechanism is released from its fastener holding position and moved in a direction opposite the feeding direction so as to complete the operating cycle of the actuating mechanism.

2. A mechanism as defined in claim 1, wherein said actuating mechanism includes a spring member which biases the holding mechanism and thus the fasteners toward the drive track during the operative stroke and a piston including an actuating rod coupled to the holding mechanism, the piston being slidingly received in a cylinder and pneumatically connected to a plenum chamber of the fastener driving apparatus so as to be supplied with plenum air after the drive element moves downward within the drive track and contacts the leading fastener, the plenum air moving the piston so as to overcome the bias of the spring member permitting the actuating rod to cause the holding mechanism to release from its holding position, the plenum air supplied to the piston exhausting after completion of the return stroke of the driving element permitting the spring member to bias the holding mechanism and thus the fasteners again toward the drive track so that another fastener may be disposed within the drive track to be contacted by the driving element.

3. A mechanism as defined in claim 1, wherein said holding mechanism includes a feed block operatively coupled to said actuating mechanism, said feed block supporting a pair of feed pawls disposed on opposing sides of the fastener package, each feed pawl of the pair of feed pawls feeding and holding the fastener package during the operative stroke of the actuating mechanism.

4. A mechanism as defined in claim 3, wherein said feed pawls have first and second ends, said first ends being pivotally coupled to said feed block by pins, each of said second ends being coupled to a compression spring disposed axially offset from said pins, whereby during the operative stroke of the actuating mechanism, said compression springs bias the feed pawls to hold the fasteners in position towards the drive track, said feed pawls being moved against the bias of said compression springs away from the fasteners during the return stroke of the actuating mechanism.

5. A mechanism as claimed in claim 4, wherein each said feed pawl has a tapered surface terminating at a point whereby (1) during the operative stroke of the actuating mechanism, the point of each feed pawl contacts side surfaces of the fastener package to feed and hold the fastener package in a position biased toward the drive track and (2) during the return stroke of the actuating mechanism, the feed pawls are moved from the holding position due to the fasteners contacting the tapered surface, without permitting the fasteners to move substantially in a direction away from the feeding direction.

6. A mechanism as claimed in claim 1, wherein during the return stroke of the actuating mechanism, the holding mechanism moves in a direction opposite the feeding direction so as to contact successive fasteners of the fastener package.

7. A mechanism as claimed in claim 1, wherein the fastener package is in the form of a stick.

8. A mechanism as claimed in claim 1, wherein the fastener holding mechanism is in contact with the fastener package during the entire operating cycle of the actuating mechanism.

* * * * *